United States Patent [19]

Evans

[11] Patent Number: 4,651,546

[45] Date of Patent: Mar. 24, 1987

[54] HIGH SECURITY ROTARY DISC, PIN TUMBLER TYPE CYLINDER LOCK

[75] Inventor: Walter R. Evans, Lancaster, Ky.

[73] Assignee: Sargent & Greenleaf, Inc., Nicholasville, Ky.

[21] Appl. No.: 825,675

[22] Filed: Jan. 30, 1986

Related U.S. Application Data

[63] Continuation of Ser. No. 622,054, Jun. 18, 1984, abandoned.

[51] Int. Cl.[4] ..... E05B 29/04

[52] U.S. Cl. ..... 70/366; 70/377

[58] Field of Search ..... 70/366, 364 A, 358, 70/369, 377, 378, 392, 421, 349, 376

[56] References Cited

U.S. PATENT DOCUMENTS

| | | | |
|---|---|---|---|
| 408,147 | 7/1889 | Taylor | 70/366 |
| 2,648,972 | 8/1953 | Diesel . | |
| 3,479,849 | 11/1969 | Check . | |
| 3,531,959 | 10/1970 | Weber | 70/364 A |
| 3,789,638 | 2/1974 | Roberts et al. . | |
| 3,948,065 | 4/1976 | Martikainen . | |
| 4,008,588 | 2/1977 | Miller et al. | 70/366 |
| 4,083,212 | 4/1978 | Proefrock | 70/366 |
| 4,359,886 | 11/1982 | Evans et al. | 70/366 |
| 4,407,147 | 10/1983 | Larson . | |

FOREIGN PATENT DOCUMENTS

| | | | |
|---|---|---|---|
| 25618 | 10/1952 | Finland . | |
| 2038401 | 7/1980 | United Kingdom | 70/366 |
| 2036851 | 7/1980 | United Kingdom | 70/366 |

*Primary Examiner*—Robert L. Wolfe
*Assistant Examiner*—Lloyd A. Gall
*Attorney, Agent, or Firm*—Mason, Fenwick & Lawrence

[57] ABSTRACT

A cylinder lock of the rotary disc tumbler and pin tumbler type having an outer cylindrical shell casing, a plug assembly in the said casing including an inner shell member rotatable therein forming a shear line between the casing and shell member and a stack of locking disc tumblers within the shell member. The casing houses a plurality of elongated, axially slidable segmented pin tumblers biased toward the disc tumblers each having a separation line intermediate its length. The disc tumblers each have a stepped bottom peripheral gate alignable with and adapted to receive adjacent portions of the pin tumblers therein to various depths causing pin tumbler portions spaced from said separation line to cross the shear line in a locked position of the plug assembly and are movable by key rotation of the disc tumblers to align their separation lines with the shear line to unlock the plug assembly for rotation.

15 Claims, 6 Drawing Figures

HIGH SECURITY ROTARY DISC, PIN TUMBLER TYPE CYLINDER LOCK

This application is a continuation of application Ser. No. 622,054, filed June 18, 1984 now abandoned.

BACKGROUND AND OBJECTS OF THE INVENTION

The present invention relates in general to cylinder-type key locks having a plurality of key set tumblers, and more particularly to key-operated rotary plug cylinder locks utilizing a key plug whose rotation is controlled by a plurality of rotary disc-type tumblers operated by a key having an angled bitting formed from a generally round key and also having a plurality of pin tumblers positioned by the key set tumbler discs.

One of the common types of key locks which have come into wide use is the type known as a cylinder lock. Conventional cylinder locks normally comprise a relatively fixed housing forming the lock body or casing having a cylindrical bore opening through the front or rear face of the lock body which rotatably houses a rotating cylinder or plug assembly. The rotatable cylinder or plug assembly has a keyway or key slot opening through the front or rear face of the cylinder or plug and extending over most of the axial length thereof, as well as one or more resiliently urged tumblers formed of rotatable or slidable members which normally occupy positions crossing the shear zones or interface zones at boundaries between the rotatable cylinder core or plug and the outer body or shell preventing rotation of the core relative to the body or shell. When a key of proper contour or combination surfaces is inserted in the keyway or key opening in the cylinder core or plug, the contoured key surface aligns the resiliently urged tumblers in such a way that a parting line, either of the tumbler members or of some other locking member coactive with the tumbler members, is brought into coincidence with the interface plane at the shear zone, or the locking member is withdrawn from interference in the path of the interface plane or peripheral surface of the core or plug. Thus, when all of the tumblers are properly aligned by the contoured key surface, rotational forces applied to the key permit the core or plug to turn through the normal motion involved in moving the lock, from a locked to an unlocked condition.

Due to conditions which arise in the construction of the lock parts under normal manufacturing tolerances, it has been possible in cylinder locks which are not provided with special pick resistant features to achieve unauthorized operation of the lock by such picking techniques as inserting a picking tool into the keyway and exerting a torque on the plug so that with careful movement of the plug in selected directions, the resiliently urged tumbler first placed in compression by torquing the plug is aligned by the pick for clearance at which point the plug rotates a minute degree to bring the next resiliently urged tumbler into a similar compressed condition and is aligned by the pick for clearance, and this succession of operations is repeated until all of the tumblers have been aligned to permit the plug to be rotated.

One of the most common types of cylinder locks is the pin tumbler type cylinder lock, wherein segmented tumbler pins formed of lower key engaging pin segments and upper drive pin segments have a line of separation between the segments which is normally displaced from the interface plane or the shear line of the plug but is positioned by the proper key so that the line of separation of all of the pin tumblers align with the plug shear line and permit rotation of the plug. Such pin tumbler type cylinder locks have been particularly susceptible to the above described types of picking techniques, and many attempts have been made to provide them with resistance to such picking operations. In some cases, the pin tumblers have been so constructed that the tampering by picking techniques with one of the tumbler pins automatically locks the remaining tumblers against further movement, or additional recesses have been provided in the outer cylindrical casing so that after a pin tumbler has been picked it re-engages in the absence of clearance of the remaining pin tumblers, or lock out devices have been provided so that attempts to pick one or more of the pin tumblers results in additional locking pins being activated to lock the plug against rotation even by authorized persons.

To increase resistance to picking by the techniques which are successful with pin tumbler type cylinder locks, cylinder locks of the rotary disc tumbler type have come into wider use. A popular type of rotary disc tumbler cylinder lock is the so-called Abloy lock, wherein a bank of peripherally gated rotary locking discs housed within a rotatable sleeve member have shaped center apertures which respond to a proper key surface to align the gates to permit radially inward movement of a locking bar which normally traverses the shear line between the rotary sleeve and an outer fixed cylinder casing. Such rotary disc tumbler type cylinder locks may be of the general type disclosed in U.S. Pat. Nos. 3,771,340 or 3,621,689, or 3,848,442, with or without related features of other patents obtained by the Finnish corporation Oy Wartsila Ab relating to the Abloy lock. Unauthorized detection of such rotary disc tumbler cylinder locks has been achieved, however, by techniques such as introducing a picking probe or similar tool into the key opening to interpose an offset shaped extension thereof between the faces of successive rotary disc tumblers and manipulating the probe to detect the position of the key engaging shoulder formation and/or of the peripheral gates of the respective tumblers by observing the angular position of the probe externally of the lock and determine therefrom the key combination or shaped surface contour of the key for that lock. Also, techniques of torquing the cylinder or plug of such locks in a special manner to distort metal from some of the lock components into normally vacant spaces within the lock by application of strong torquing forces to the cylinder or plug have resulted in authorized penetration of the lock.

I have recognized that in some applications for cylinder type locks in areas where a higher degree of security is required than is available from the conventional pin tumbler type cylinder lock or the rotary disc tumbler type cylinder locks, higher security characteristics providing greater pick resistance and greater resistance to torque lock penetration techniques can be achieved by combining features of the disc tumbler type locks with features of pin tumbler type locks to introduce features of both types of locks into one cylinder lock construction.

Accordingly, an object of the present invention is the provision of a novel rotary plug cylinder lock having rotary disc type tumblers and pin tumblers, constructed to resist unauthorized detection of the key combination for the lock and resist unauthorized penetration of the lock by torquing or picking techniques.

Another object of the present invention is the provision of a rotary plug cylinder lock as described in the immediately preceding paragraph, wherein the key plug is freely rotatable through a full 360° unless all of the pin tumblers are properly positioned so that their line of separation is registered with the plug shear line.

Another object of the present invention is the provision of a novel rotary plug cylinder lock as described in the two immediately preceding paragraphs, wherein the key never comes into contact with the tumbler pins, thereby improving security of the lock.

Yet another object of the present invention is the provision of a novel rotary plug cylinder lock as described in the three immediately preceding paragraphs, wherein the lock is readily adaptable to right hand or left hand operation by cutting the key in either clockwise or counterclockwise directions and assembling the disc tumblers and pins to the correct spacing and depths.

Other objects, advantages, and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figure 1:
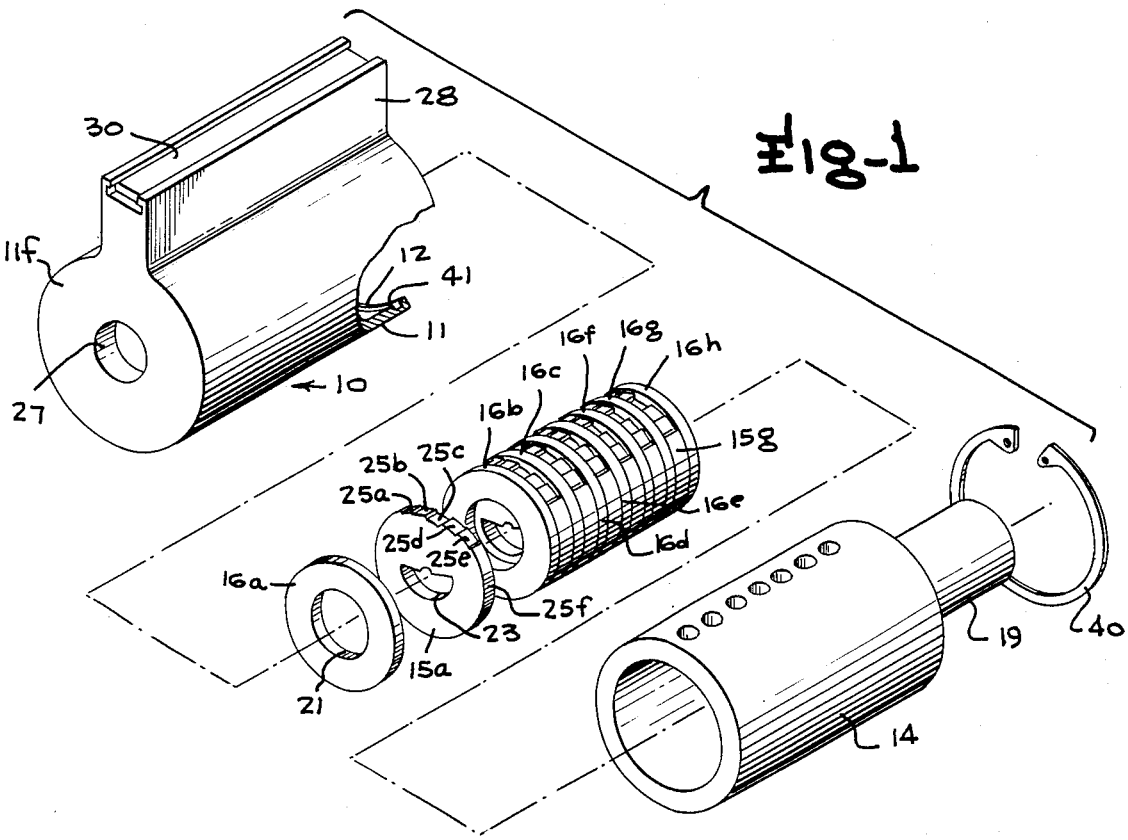
FIG. 1 is an exploded perspective view of a rotary plug cylinder lock and associated key, constructed in accordance with the present invention.
Figure 5:
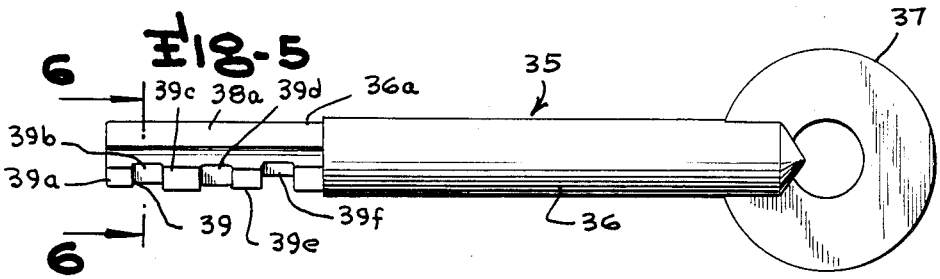
FIG. 5 is an elevational view of a typical key for unlocking the lock.
Figure 6:
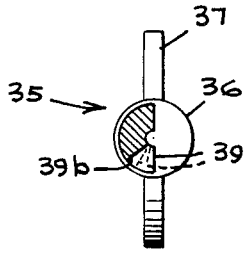
FIG. 6 is a section view taken along the like 6—6 of FIG. 5, with representative circumferential angle indications thereon.
Figure 2:
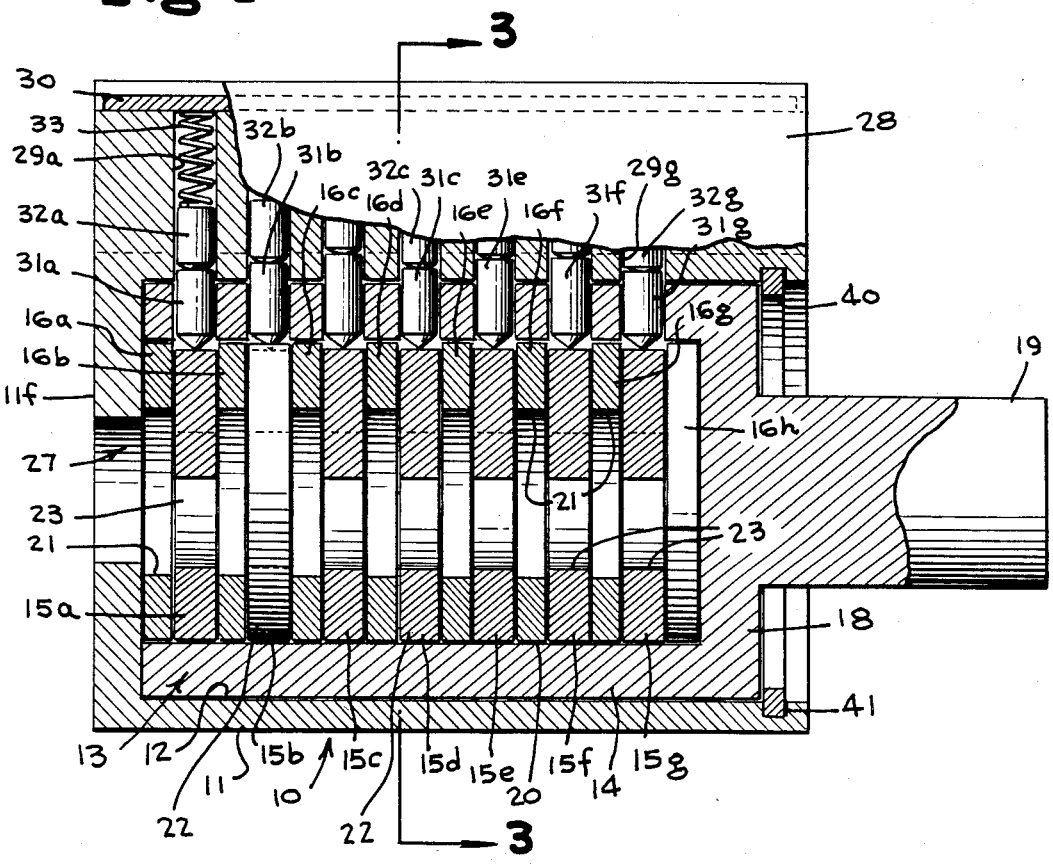
FIG. 2 is a vertical longitudinal section view thereof, taken along the line 2—2 of FIG. 3.
Figure 3:
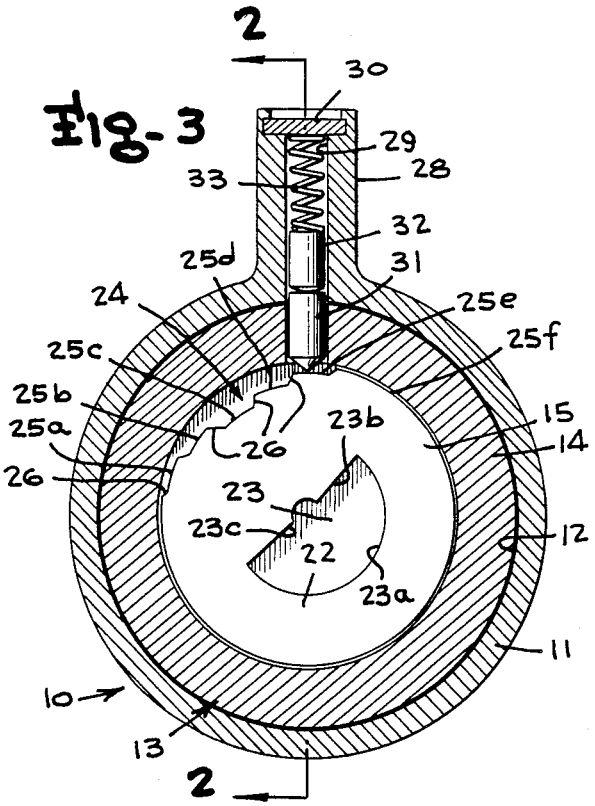
FIG. 3 is a vertical transverse section view thereof, taken along the line 3—3 of FIG. 2, showing the lock in locked condition.
Figure 4:
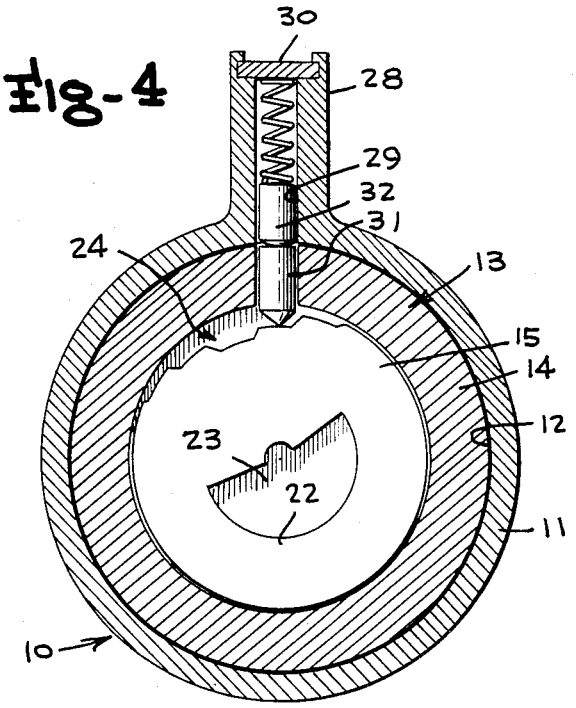
FIG. 4 is a vertical transverse section view taken from the same section plane as FIG. 3 but showing the lock in unlocked condition.

Referring to the drawings, wherein like reference characters designate corresponding parts throughout the several figures, the cylinder lock of the present invention is indicated generally by the reference character 10, and comprises a generally cylindrical lock housing or casing 11 having a rearwardly opening cylindrical bore 12 housing a rotatable plug assembly 13. The rotatable plug assembly includes a cylindrical outer plug sleeve or shell member 14 which encloses a stack of rotatable locking discs or tumbler discs 15 arranged in a stacked array concentric with the center axis of the outer shell 14 of the plug. Annular washers or spacers 16 are provided between successive tumbler discs 15. In the illustrated embodiment, there are seven tumbler discs **15*a* through 15*g* and seven annular washers or spacers 16*a* through 16*g*, together with the rearmost solid washer 16*h* which is a hardened disc located at the rear of the inner cylinder to resist drilling or like penetration. The sleeve member 14 of the plug assembly has a cylindrical rear wall 18 sized to closely fit within the rearwardly opening bore 12 of the stationary cylindrical casing 11, and is provided with an integral boss or coupling formation 19 of any desired shape to be connected to a bolt or link mechanism of conventional configuration to be positioned by rotation of the plug assembly 13, and specifically the outer shell 14 thereof, to locked and unlocked positions when the cylinder lock plug assembly 13** is rotated from locked to unlocked position upon insertion and appropriate rotation of a proper key.

In the illustrated embodiment, the spacer members **16*e* to 16*g* are annular discs as shown in FIG. 1, having a cylindrical outer periphery, indicated at 20, and a circular center opening 21 of larger diameter than the key openings of the tumbler discs later described. As previously described, the rearmost washer disc 16*h*** is a hardened spacer to provide drill resistance.

The seven tumbler discs **15*a*–15*g* are of uniform standardized construction, facilitating assembly and reducing costs of such lock, formed from distorted cylindrical discs indicated at reference character 22 and a slightly-more-than semi-circular key opening 23 therein defined by a circular or arcuate boundary 23*a* of uniform radius and two radial boundary walls 23*b* and 23*c* forming an angle of about 190° relative to the center axis in the direction of the keyway 23. The outer perimeter 22 of the disc tumblers 15 are shaped to define six different radially spaced surfaces provided by a five land gate 24 forming the five radially spaced lands 25*a*–25*e*, bounded on one edge by an inclined wall or surface 26 providing in effect beveled transition surfaces 26 between the several lands or different radial pin positioning surfaces, the sixth surface being the outer periphery of the tumbler 15**.

The front wall of the housing or casing 11, which is indicated at **11*f* is provided with a circular key access opening 27 of similar diameter to the shank of the key for operating the lock. Rising vertically from the lock housing or casing 11 in the orientation illustrated in the drawings is an elongated pin tower formation 28 formed integrally with the outer cylindrical casing portion 11 and extending from the front surface to near the rear end thereof, which is provided with a plurality of pin receiving cylindrical bores 29*a* through 29*g*, closed at the top by a pin tower cover 30 as illustrated. The pin receiving bores 29 include a pair of sets of cylindrical pins, each set comprising a lower pin section 31, corresponding in number to the number of disc tumblers and indicated by the reference characters 31*a*–31*g* respectively and a corresponding number of upper pin sections 32, indicated individually by reference characters 32*a*–32*g* associated with the respective lower pin sections 31*a*–31*g*. As illustrated in the drawings, in the preferred embodiment, the lower working surface portions of the lower pin sections 31 are of conical configuration while the upper ends of the lower pin sections are flat, and the lower ends of the upper pin sections 32 are rounded or of partially spherical configuration and the upper ends thereof are flat. The upper ends of the upper pin sections 32 butt against coil springs 33 captured between the upper ends of the pin sections 32 and the pin tower cover 30, continuously resiliently biasing the sets of pin sections 31, 32** toward the peripheries of their associated disc tumblers.

The operating key for the above described cylinder type key lock, in the illustrated example, may be of the configuration shown at 35, formed basically from solid rod stock providing an elongated cylindrical shank portion 36 extending from a flattened handle formation 37, and having a slightly smaller diameter front or working end portion 36*a* of the shank cut to slightly more than a semi-circular or 180° cross-section. This provides a radial surface 38*a* extending in one direction from the center axis thereof and shoulders extending in the opposite direction at various angles forming the combination surfaces 39 thereof or bittings cut to the proper radial or circumferential angle so that, upon rotation in the proper direction to abut the radial surfaces 23*c* bounding the tumbler disc openings 23, the tumbler discs will be rotated circumferentially or angularly to the proper extent to position the tumbler pins so that their lines of separation are all aligned with the shear plane of the lock cylinder at the outer surface 14*a* of the shell member 14. The angled bitting or combination surface cuts, indicated at 39*a*–39*f* in the illustrated embodiment, of the key are cut in accordance with a predetermined key coding to provide combination surfaces 39 preferably having combination values at various incremental step angles, for example, spaced about 18° apart. The bit cuts may be spaced angularly or circumferentially in a manner similar to the customary key cutting code for keys for the Abloy rotary disc cylinder locks of the type for the previously identified Oy Wartsila U.S. patents or the keys for the earlier U.S. Pat. Nos. to Miller et al 4,008,588 or 4,062,211.

For example, the keys may be cut at step angles providing differently circumferentially spaced combination surfaces or shoulders 39 spaced 18° apart, thus providing six possible angular positions located at radial angles of 0°, 18°, 36°, 54°, 72°, or 90°. The six possible combination surface angles are correlated to the angular positions and depths of the radially spaced lands 25*a*–25*e* and the outer peripheral surface 25*f* of the tumbler discs, as well as the axial sizes of the tumbler pin sections 31 and 32, in accordance with a key code, thereby facilitating assembly of such locks with coded tumbler pins of different chosen predetermined axial dimensions in the particular key code and the key for such lock can then be cut to provide the appropriate radial angles for the combination surfaces 39 for the particular set of coded tumbler pins 31–32 assembled in the lock to achieve opening of the lock by that particular key.

The lock is readily assembled by simply inserting a stack of alternating spacers 16 and tumbler discs 15 in the rearwardly opening bore 12 of the lock casing 11, and securing the stack of spacers and tumbler discs and the sleeve member 14 therein by a retaining spring member 40, for example, inserted in the inwardly opening annular groove 41 adjacent the rearmost end of the outer lock housing or casing member 11. The sets of lower and upper tumbler pins 31 and 32 are then inserted in the pin receiving bores 29 of the pin tower formation 28, the coil springs 33 are then inserted in the bores 29 above the sets of tumbler pins, and the pin tower cover is then assembled in the top portion of the pin tower formation to complete the assembly. When a key 35 cut to provide the proper combination surfaces 39 for the sets of tumbler pins 30, 31 which have been assembled in the lock, is inserted in the front key opening 27 and into the openings 23 of the stack of tumbler discs 15*a*–15*g*, and the key is rotated, for example in a clockwise direction as viewed from the front from the initial orientation at the fully inserted position, the combination surfaces 39 of the key at different angular positions engage the boundary walls 23*c* of the disc tumblers 15 after different amounts of angular rotation of the key until the radial boundary walls 23*c* of all of the tumbler discs 15*a*–15*g* are in abutment with their associated combination surfaces 39 of the key at the proper step angles so that, at a particular angular position of the key displaced from the insertion position, the plane of separation between all of the upper tumbler pin sections 32 and their associated lower tumbler pin sections 31 is aligned with the interface plane or shear zone 14*a* of the lock cylinder between the cylindrical outer surface of the outer shell 14 and the confronting inner cylindrical surface of the bore 12 in the casing 11. The plug sleeve or shell member 14 together with the lower tumbler pin sections 31 and the tumbler discs 15 then all rotate in unison under the force of the key to the unlocking position, effecting retraction of the bolt or similar member to be operated thereby coupled or linked to the coupling formation 19 projecting rearwardly from the sleeve member 14. When the lower pin sections 31 are all properly positioned upon appropriate rotation of the proper key, so that the plane of separation of the upper and lower pin sections becomes aligned with the shear line or shear plane 14*a* between the sleeve or shell member 14 and the bore 12, the lower pins then transfer force to the inner cylinder tending to rotate it by continued rotation of the key to rotate the plug assembly to the unlocking position, and similar action caused by the pins pushing the side of the inner cylinder upon rotation of the key in the opposite direction return the cylinder to the unlocking position where the lower tumbler pin sections are then positioned axially to place their planes of separation with the upper pin sections out of alignment with the shear plane or interface plane 14*a*, returning the lock to its locked condition.

By this construction, a more pick-resistant lock is provided since torque cannot be applied to find the shear line, the tumbler discs as well as the other parts being rotatable a full 360° without applying force to the inner cylinder unless all of the tumbler pins are properly aligned with the shear line. Similarly, this renders the lock highly resistant to unauthorized opening of the lock by torquing techniques. Since the key in this lock construction never comes into contact with the tumbler pins and the tumbler discs with the inner cylinder or plug 14 when properly positioned by the appropriate key rotate 360° without applying force, the lock is impression proof. It will be appreciated that this construction also facilitates assembly of locks for right hand or left hand operation simply by cutting the key in either clockwise or counterclockwise directions and assembling the tumbler discs and pins to the correct spacings and depths.

I claim:

1. A cylinder lock of the rotary disc tumbler and pin tumbler type comprising a stationary casing in the form of an outer cylindrical shell having a front end wall provided with a key opening for passage of a key therethrough and a cylindrical bore extending rearwardly therefrom, a plug assembly in said bore including an inner shell member rotatable therein forming a shear line therewith at an interface between the casing and shell member and a plurality of locking disc tumblers in a stacked array encircled within such shell member and rotatable about a common axis therein, the casing having a formation housing a plurality of elongated, axially slidable segmented pin tumblers arranged with their axes arranged in a radial plane extending through said common axis and located radially outwardly and biased toward the disc tumblers, each pin tumbler having a separation line intermediate its length defining inner and outer pin segments, the disc tumblers each having a stepped bottom peripheral gate alignable with and adapted to receive adjacent portions of the pin tumblers therein to various depths causing pin tumbler portions spaced from said separation line to cross said shear line in a locked position of the plug assembly and prevent rotation of the inner shell member within the casing, the stepped bottom of each gate providing a series of bottom portions spaced a plurality of different depths from the tumbler peripheries correlated to the axial lengths of the inner pin segments in accordance with predetermined key bitting configurations, and the disc tumblers having central key openings therein to receive end portions of the key shaped to provide key engaging surfaces at circumferentially spaced angles correlated to the key bitting configurations to effect different angular rotations of the disc tumblers by the key positioning the stepped bottom portions to locate the pin tumblers so that their separation lines register with said shear line releasing the plug assembly to be rotated by the key to unlocked open position.

2. A cylinder lock as defined in claim 1, wherein said bore of said casing opens rearwardly through the casing and has an inwardly facing circumferential groove in the bounding surface of the bore adjacent to the rearmost end thereof, and an interrupted ring shaped retaining spring is removably seated in said groove and rearwardly overlapping portions of said inner shell member retain the same rotatably seated within the bore of said casing.

3. A cylinder lock as defined in claim 1, where said plug assembly includes an annular spacer interposed between each of said disc tumblers in said stacked array and similarly shaped annular spacers at the front and rear of the stacked array of disc tumblers located within said inner shell member have an outer diameter corresponding substantially to the maximum outer diameter of the disc tumblers.

4. A cylinder lock as defined in claim 1, wherein said key has a circular cross section key shank and a key bitting end portion formed from a substantially semicircular cross section having axially and circumferentially spaced cutouts defining key bit abutment surfaces at various predetermined circumferentially spaced angular positions and said disc tumbler central key opening being of part circular cross section defining a substantially radial bounding surface positioned relative to the gate bottom portions so as to effect key rotation of the disc tumblers to proper angular positions to cause alignment of the pin tumbler separation lines with said shear line.

5. A cylinder lock as defined in claim 4, where said plug assembly includes an annular spacer interposed between each of said disc tumblers in said stacked array and similarly shaped annular spacers at the front and rear of the stacked array of disc tumblers located within said inner shell member have an outer diameter corresponding substantially to the maximum outer diameter of the disc tumblers.

6. A cylinder lock as defined in claim 4, wherein the lands provide abutment surfaces facing outwardly towards said inner shell member to be disposed in confronting relation with adjacent inner segments of the pin tumblers to receive such pin tumbler segments in abutment therewith and transition surfaces are provided between adjacent lands inclined at angles to radii from said common axis to define inclined ramp transition surfaces between the lands.

7. A cylinder lock as defined in claim 4, wherein said bore of said casing opens rearwardly through the casing and has an inwardly facing circumferential groove in the bounding surface of the bore adjacent to the rearmost end thereof, and an interrupted ring shaped retaining spring is removably seated in said groove and rearwardly overlapping portions of said inner shell member retain the same rotatably seated within the bore of said casing.

8. A cylinder lock as defined in claim 4, wherein the stepped bottom gate in each of said tumblers is shaped to define land surfaces at various predetermined different radial distances from said common axis providing a terraced stepped gate bottom configuration with the lands spaced at different circumferential angles from said center axis whereby the lands permit entry of the adjacent inner segments of the tumbler pins at different distances into the gate depending upon the angular position of the associated disc tumbler.

9. A cylinder lock as defined in claim 8, wherein the lands provide abutment surfaces facing outwardly towards said inner shell member to be disposed in confronting relation with adjacent inner segments of the pin tumblers to receive such pin tumbler segments in abutment therewith and transition surfaces are provided between adjacent lands inclined at angles to radii from said common axis to define inclined ramp transition surfaces between the lands.

10. A cylinder lock as defined in claim 1, wherein the stepped bottom gate in each of said tumblers is shaped to define land surfaces at various predetermined different radial distances from said common axis providing a terraced stepped gate bottom configuration with the lands spaced at different circumferential angles from said center axis whereby the lands permit entry of the adjacent inner segments of the tumbler pins at different distances into the gate depending upon the angular position of the associated disc tumbler.

11. A cylinder lock as defined in claim 10, where said plug assembly includes an annular spacer interposed between each of said disc tumblers in said stacked array and similarly shaped annular spacers at the front and rear of the stacked array of disc tumblers located within said inner shell member have an outer diameter corresponding substantially to the maximum outer diameter of the disc tumblers.

12. A cylinder lock as defined in claim 10, wherein said bore of said casing opens rearwardly through the casing and has an inwardly facing circumferential groove in the bounding surface of the bore adjacent to the rearmost end thereof, and an interrupted ring shaped retaining spring is removably seated in said groove and rearwardly overlapping portions of said inner shell member retain the same rotatably seated within the bore of said casing.

13. A cylinder lock as defined in claim 10, wherein the lands provide abutment surfaces facing outwardly towards said inner shell member to be disposed in confronting relation with adjacent inner segments of the pin tumblers to receive such pin tumbler segments in abutment therewith and transition surfaces are provided between adjacent lands inclined at angles to radii from said common axis to define inclined ramp transition surfaces between the lands.

14. A cylinder lock as defined in claim 13, wherein said bore of said casing opens rearwardly through the casing and has an inwardly facing circumferential groove in the bounding surface of the bore adjacent to the rearmost end thereof, and an interrupted ring shaped retaining spring is removably seated in said groove and rearwardly overlapping portions of said inner shell member retain the same rotatably seated within the bore of said casing.

15. A cylinder lock as defined in claim 13, where said plug assembly includes an annular spacer interposed between each of said disc tumblers in said stacked array and similarly shaped annular spacers at the front and rear of the stacked array of disc tumblers located within said inner shell member have an outer diameter corresponding substantially to the maximum outer diameter of the disc tumblers.

* * * * *